United States Patent [19]

Boros

[11] 4,253,531

[45] Mar. 3, 1981

[54] SELF-BALANCING VIBRATORY DRILL APPARATUS

[76] Inventor: Ladislav J. Boros, 1460 52nd St., Brooklyn, N.Y. 11219

[21] Appl. No.: 85,729

[22] Filed: Oct. 17, 1979

[51] Int. Cl.[3] ..... E21B 4/06

[52] U.S. Cl. ..... 175/56; 175/106; 175/171; 175/298; 175/321; 175/325; 175/413

[58] Field of Search ..... 173/93, 123; 175/56, 175/55, 113, 171, 299, 298, 321, 413, 319, 215, 106; 64/27 NM, 30 D

[56] References Cited

U.S. PATENT DOCUMENTS

| | | | |
|---|---|---|---|
| 701,547 | 6/1902 | Davis | 175/171 |
| 1,870,540 | 8/1932 | Wells | 175/298 |
| 2,066,794 | 1/1937 | Miller | 175/321 |
| 2,742,264 | 4/1956 | Snyder | 175/298 |
| 2,815,930 | 12/1957 | Storm | 175/321 X |
| 3,106,973 | 10/1963 | Christensen | 175/413 |
| 3,760,894 | 9/1973 | Pitifer | 175/413 |
| 3,768,578 | 10/1973 | Russel, Jr. | 175/321 |
| 3,932,956 | 1/1976 | Young | 64/30 D |
| 3,942,338 | 3/1976 | Furlehe | 64/27 NM |
| 3,957,125 | 5/1976 | Russell, Jr. | 175/321 |

*Primary Examiner*—William F. Pate, III
*Attorney, Agent, or Firm*—Steinberg & Raskin

[57] ABSTRACT

Vibratory drill apparatus is disclosed which is adapted for automatic self-balancing to compensate for variations in hardness of the material being drilled and/or dulling of the cutting blades which occurs during the drilling operation. The apparatus includes a tubular casing adapted to be connected to a rotating shaft and a drill assembly comprising a plurality of coaxially extending pipe members, each being located one within the other, the upper region of the drill assembly being received within the lower region of the casing. A drill head is defined at the lower region of the drill assembly. The pipe members are interconnected such that they are mutually fixed to each other for simultaneous rotation about their axis and such that each pipe member is free to move in the axial direction relative to the other pipe members. Apparatus is provided for periodically applying an impulse torque to the drill assembly which tends to periodically rotate the entire assembly about its axis and for periodically applying to at least one of the pipe members an impulse force in the direction of the axis of the drill assembly. In the preferred embodiment this apparatus includes a pair of rollers adapted to ride over the upper edges of the pipe members, the latter being provided with appropriately shaped cam surfaces. Apparatus for damping vibrations during the drilling operation, for providing forced hydraulic mud circulation and for facilitating the withdrawal of the drill apparatus are also disclosed.

32 Claims, 27 Drawing Figures

FIG. 10
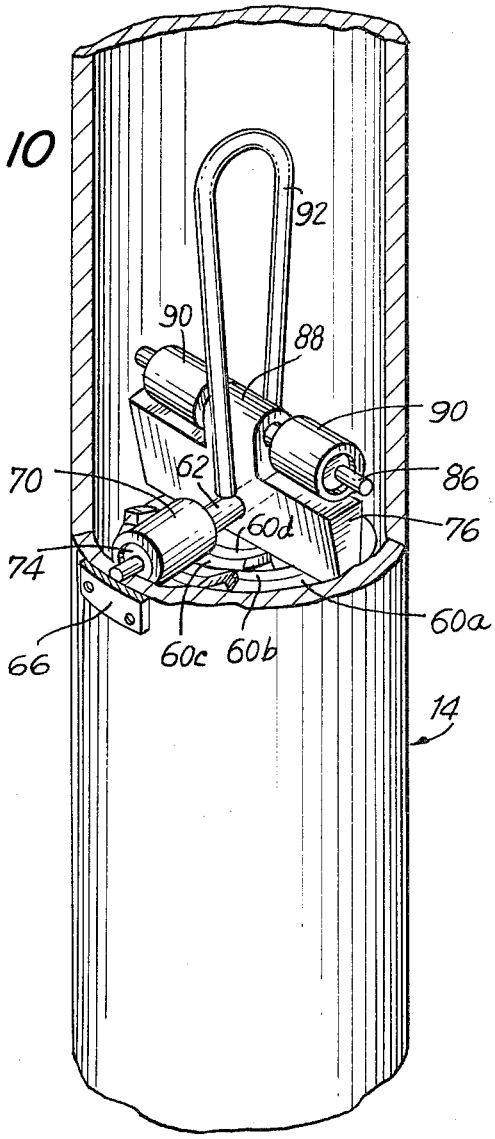
FIG. 11
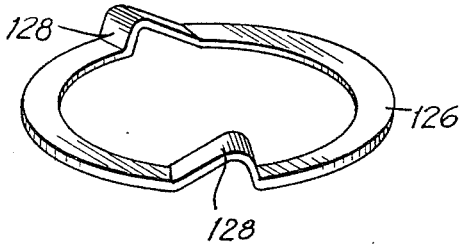
FIG. 12
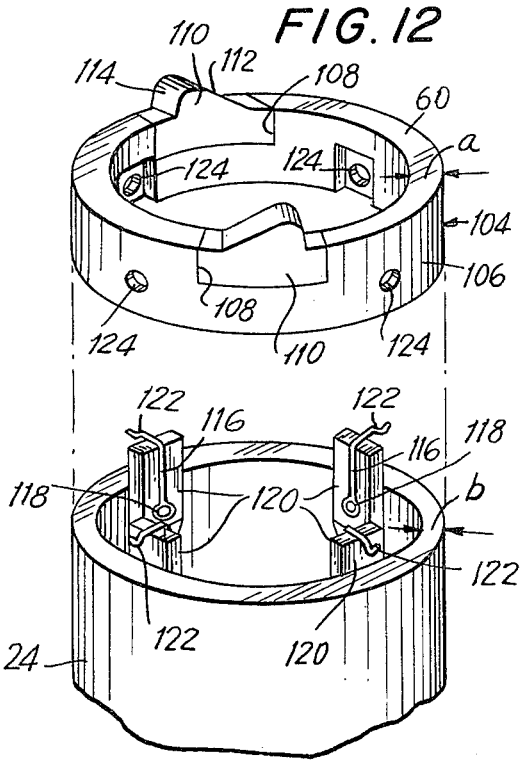
FIG. 13
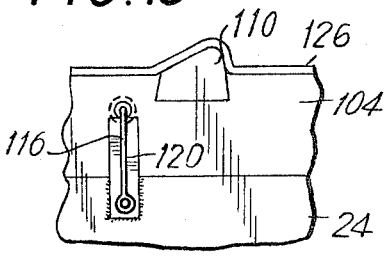
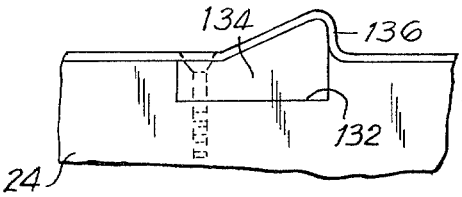
FIG. 14
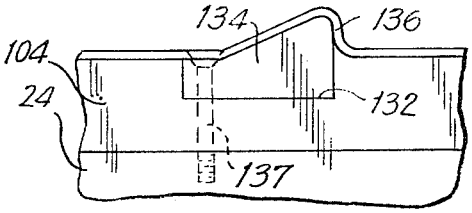
FIG. 14A

SELF-BALANCING VIBRATORY DRILL APPARATUS

BACKGROUND OF THE INVENTION

This invention relates generally to well drilling apparatus and, more particularly, to rotary and vibratory drilling apparatus.

Rotary well drilling apparatus wherein a percussive or vibratory action is provided are well known. For example, such apparatus are disclosed in U.S. Pat. Nos. 1,745,351; 1,748,341; 2,072,470; 2,241,712; and 2,667,144.

However, such conventional drilling apparatus are not entirely satisfactory for a variety of reasons. A major disadvantage of such conventional apparatus is their relatively low rate of penetration drilling. This problem is a result of several factors all of which combine to limit the speed at which a well can be drilled. More particularly, conventional drill heads tyically have a relatively low bearing pressure capacity so that the maximum downward force which can be exerted on the apparatus is limited. For this reason, conventional drill heads frequently break during operation, especially when relatively large depths are reached (for example in excess of 10,000 feet) or where relatively small diameter bores are being drilled. It is not uncommon for the removal of the entire drill apparatus to be required every day or two in order to effect repair of broken drill heads. Another factor which limits the speed of penetration of the drill apparatus results from the fact that it can be expected that during the drilling operation, materials of varying hardness will be encountered by the drill head. Thus, it is not uncommon for a harder material to be encountered by the drill head or portions of the drill head after the drilling operation has proceeded for a period of time. In such cases, a greater axial or downward force is required to compensate for such harder material. However, it is not always possible to provide such an increased force utilizing the same drill apparatus. A third factor contributing to the relatively slow penetration speed of conventional drill apparatus is that such conventional drill apparatus, such as those disclosed in the above-mentioned United States patents, provide only a relatively slow hammer action which, although serving to break or chip the material being drilled, does not do so in an efficient manner. Yet another factor which limits the penetration speed of conventional drill apparatus is the unavoidable drilling of the cutting blades provided on the drill head during the drilling operation. In this connection, as the drilling operation proceeds, the cutting blades tend to become progressively duller. This fact coupled with the difficulty in replacing the cutting blades in conventional equipment is a serious problem.

Conventional drill apparatus have still other drawbacks. For example, where several bores having different diameters must be drilled, it is necessary to employ different drill apparatus with appropriate dimensions. This of course seriously increases the cost of such drilling operations. The removal of mud as well as the broken material formed at the bottom of the bore also is not satisfactorily accomplished in conventional apparatus. Thus, such mud removal is usually accomplished utilizing pumps or the like located at the upper end of the well and as the depth of the well increases, the effectiveness of such pumps decreases.Further, in connection with the operation of conventional percussive drill apparatus, it is not uncommon for the drill apparatus to be overstressed during the operation due to the vibrations to which the apparatus is subjected. Still another problem exists in connection with conventional apparatus in the drill insertion or lowering and withdrawal operations. Thus, during insertion, the present of mud and silt impedes the lowering of the drill apparatus. Conversely, during withdrawal of the drill apparatus, a vacuum is created in the space below the drill head which impedes the withdrawal operation.

SUMMARY OF THE INVENTION

Accordingly, one object of the present invention is to provide a new and improved drill apparatus which overcomes the drawbacks which exist in conventional drill apparatus as discussed above.

Another object of the present invention is to provide a new and improved rotary drill apparatus which is capable of a higher penetration speed than that of conventional drill apparatus.

Still another object of the present invention is to provide a new and improved drill apparatus which is automatically self-balancing, i.e., can compensate for any variations in hardness of the material being drilled as well as for the progressive dulling of the cutting blades during the drilling operation.

A further object of the present invention is to provide a new and improved drill apparatus which can be easily modified to accommodate the drilling of wells having varying bore diameters.

A still further object of the present invention is to provide a new and improved drill aparatus which facilitates the removal of mud and the like from the bore during the drilling operation.

An additional object of the present invention is to provide a new and improved drilling apparatus having a vibration damping mechanism which prevents the overstressing of the drill apparatus due to the variations to which the same is subjected.

Yet another object of the present invention is to provide a new and improved drill apparatus which can be inserted into and withdrawn from the drilled bore in a easier and faster manner than is possible with conventional drill apparatus.

Another object of the present invention is to provide a new and improved drill apparatus wherein worn components thereof, such as the cutting blades, can be easily replaced by unskilled workers and wherein the drill head assembly can be reused.

Briefly, in accordance with the present invention, these and other objects are obtained by providing drill apparatus including a substantially tubular casing which is adapted to be connected to a rotating shaft and a drill assembly comprising a plurality of elongate, coaxially extending pipe members, each being located one within the other. The upper region of the drill assembly is received within the lower interior region of the casing and the lower region of the drill assembly comprises the drill head. The pipe members comprising the drill assembly are interconnected in a manner such that they are mutually fixed to each other for simultaneous rotation about their axis and such that each pipe member is free to move in the axial direction independently relative to the other pipe members.

Apparatus is provided for periodically applying to the drill assembly an impulse torque, i.e.., torque of relatively short duration, which tends to periodically rotate the pipe members comprising the drill assembly in unison about their axis and, additionally, for periodically applying to at least one or several of the pipe members an impulse force, i.e., a force of relatively short duration, in the downward direction parallel to the axis of the drill assembly.

The particular construction of the drill assembly which includes a plurality of coaxial pipes each being located within another and with the drill head being provided on the lower end region thereof significantly increases the bearing pressure capacity of the drill apparatus relative to conventional apparatus. Further, the drill apparatus is easily modified to adapt the same for drilling wells of varying diameters by merely adding additional larger diameter pipe members in the case where larger diameter bores are to be drilled or by removing the outer pipe members where smaller diameter bores are required.

According to the illustrated preferred embodiment, the apparatus for applying impulse torques and forces to the drill assembly comprises a pair of rollers mounted on a shaft which diametrically extends within the casing interior immediately above the upper edges of the pipe members defining the drill assembly. The upper edges of the pipe members are provided with cam surfaces so that as the casing rotates, the rollers ride over the upper edges of the pipe members and over the cam surfaces provided thereon. Each cam surface is defined by an upwardly inclined portion in the direction of the movement of the rollers and a substantially vertical end surface. Thus, as the casing rotates, the rollers engage the respective cam surfaces provided on the pipe members, the cam surfaces on the respective pipe members being offset with respect to each other so that each roller encounters a can surface or surfaces on one pipe member at any time. Upon the roller engaging the upwardly inclined portion of a cam surface, a rotary torque is applied to the respective pipe member tending to rotate it and the other pipe members about the axis of the drill assembly. Further rotation of the casing results in the cam roller falling over the vertically extending cam surface portion whereupon the roller impacts against the upper edges of the pipe members imparting a vertical impact force to the pipe members. Thus, as the casing is rotated the rollers continually ride over the respective cam surfaces applying impulse torques and downwardly directed impulse forces to the drill assembly.

Additionally, a rotational torque is periodically applied to the drill assembly by means of a bar which diametrically extends through aligned slots formed in the pipe members, the ends of the bar extending through the outer pipe member into the space defined between the inner surface of the casing and the outer surface of the outer pipe member. A plurality of flexible members are affixed to the interior surface of the casing in the region of the ends of the bar so that as the casing rotates, the flexible members engage the bar ends to impart a further rotational torque to the drill assembly. The flexible members are appropriately formed so that continued rotation of the casing results in the members deforming upon contact with the bar ends so that the bar ends will not obstruct the continued casing rotation.

By virtue of the roller and cam structure described above, a drill apparatus is provided with a self-balancing capability. More particularly, the drill head is provided through the attachment of cutting blades to the lower edges of each respective pipe member so that the lower region of the drill assembly itself comprises the drill head. When the cutting blades on one or more of the pipe members engage a harder material, that particular pipe members will tend to remain in place while the remaining pipe members move vertically downwardly. Of course, this alters the configuration of the upper edges of the pipe members over which the rollers move, so that the upper edge of that pipe member which engages the harder material will be vertically displaced above the edges of the other pipe members. Accordingly, when the rollers fall from the cam surfaces as described above, their impact will be effected substantially only on the vertically elevated pipe members thereby applying a downward force to these members only. In this manner, the variation in hardness of the material being drilled is compensated. A similar effect will occur upon the cutting blades on one or more of the pipe members becoming dull during operation so that compensation is provided for this situation also. In this connection, the blades are oriented in a particular manner relative to the direction of rotation of the head such that they tend to self-sharpen during operation of the apparatus.

Further, an improved breaking action of the material being drilled is accomplished by means of the impulse force applications described above. Thus, whereas conventional drill apparatus of the percussive type generally are capable of effecting only a relatively slow hammer action on the drill head, the vibratory action achieved by the present invention results in a vastly improved breaking up of the material being drilled. In this connection, a vibration rate of about 200 vibrations per minute is contemplated.

The fact that the cutting blades are removably affixed to the lower ends of the pipe members enables a replacement thereof in a quicker and easier manner than is possible in conventional drill apparatus wherein generally the entire drill head must be replaced upon the blades becoming dull.

Additionally, the vibratory action of the drill assembly is advantageous in that a forced hydraulic mud circulation system is inherently provided whereby the mud and broken materials located at the bottom of the well bore are removed through the space between the well bore and the outer surface of the drill assembly. More particularly, impeller-type blades are provided on the outer surface of the drill assembly and a hydraulic screw is provided in the bore of the innermost pipe member. "Clean" mud is pumped downwardly through the innermost pipe member bore and under the action of the blades and screw, a hydraulic action is created whereby "dirty" mud is forced out of the well bore through the space between the latter and the drill assembly.

The drill head is preferably formed at the lower end region of the pipe members by flaring one or more of the respective pipe members outwardly in this region so as to define a plurality of substantially conical shaped end portions for each such pipe members. One or more openings are formed in these conical surfaces, the openings in the inner pipe members being preferably offset in a downward direction relative to the openings in the outer pipe members. A hook member is fixed to a crossbar member or beam which itself is fixed within the casing, the hook member being adapted to be engaged by a cable for purposes of withdrawing the drill apparatus from the bore in the case of shaft fracture. During normal withdrawal of the drill assembly from the bore, the casing being lifted upwardly, the ends of the diametrically extending bar which extend through the aligned slots formed in the pipe members are engaged by the lower end of the upwardly moving casing thereby lifting the bar within the slots. By virtue of the configurations of the slots, the innermost pipe member will be engaged first by the bar whereupon it begins to ascend. The next innermost pipe member is then engaged whereupon it begins to move upwardly and so on. In this manner, the openings formed in the pipe members in the region of the drill head become substantially aligned thereby allowing any mud or other material to pass therethrough so that withdrawal of the drill apparatus is not impeded thereby.

In accordance with the present invention, a vibration damping mechanism is provided which functions to prevent any possible overstressing of the apparatus. More particularly, a cylindrical pipe member has its lower end region slideably received in a telescoping manner within the interior of the upper region of the casing while its upper end region is received within the interior of a hollow cylindrical shaft in a similar telescoping manner. A pair of coil springs each extends between a respective shoulder provided on a cylinder pipe member and the opposed end of the casing or cylindrical shaft, respectively. In this manner, the vibrations of the drill assembly are absorbed before they can be transmitted upwardly to the rotating drill shaft. In this connection damping rollers are rotatably mounted on the exterior surface of the hollow cylindrical shaft which have the function of both aligning the same within the bore of the well and, additionally, of damping any vibration which may be transmitted past the telescoping cylindrical pipe member.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which:

FIG. 10 is a perspective view, partially broken away, illustrating the roller arrangement and cam surfaces and additional safety roller assembly;

FIG. 11 is a perspective view of a wear surface adapted to be provided over the upper edges of the respective pipe members;

FIG. 12 is an exploded perspective view illustrating the connection of an upper cam insert to one of the pipe members of the drill assembly according to one embodiment of the present invention;

FIG. 13 is a partial side elevation view of the upper end region of a pipe member provided with the cam surface insert illustrated in FIG. 12;

FIG. 14 is a partial side elevation view of the upper edge of a pipe member illustrating a cam member associated directly therewith according to another embodiment of the present invention;

FIG. 14A is a partial side elevation view of another embodiment of the cam surface insert according to the present invention;

DESCRIPTION OF THE PREFERRED EMBODIMENTS

Figure 1:
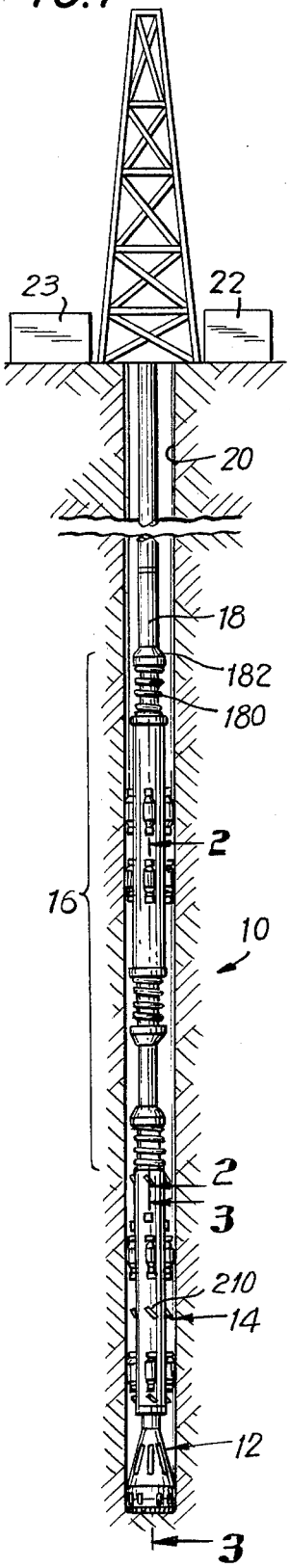
FIG. 1 is a front elevation view of a drill apparatus according to the present invention shown during drilling operation.
Figure 2:
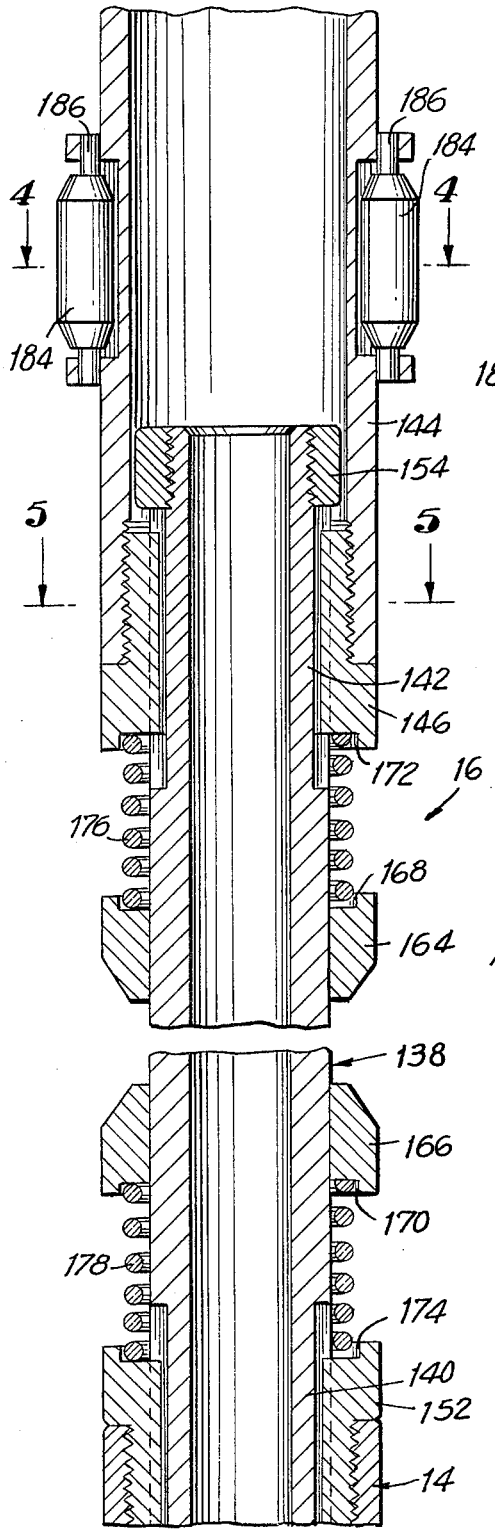
FIG. 2 is a section view taken along line 2—2 of FIG. 1 illustrating the damping mechanism in accordance with the present invention.

Referring now to the drawings wherein like reference characters designate identical or corresponding parts throughout the several views and more particularly to FIG. 1, the drill apparatus of the present invention, generally designated 10, is shown during use in connection with a drilling operation. The drill apparatus 10 includes a drill assembly 12, the upper portion thereof being located in the lower region of a casing 14. A vibration damping mechanism, generally designated 16, is connected at its lower end region to casing 14 and at its upper end region to a shaft 18 having a hollow internal bore, the latter being conventional. The shaft 10 is connected at its upper end which extends out from the well bore 20 to conventional apparatus for rotating the same, generally designated 22. Conventional mud pumping and cleaning apparatus located at the top of the well bore as designated 23.

Figure 3:
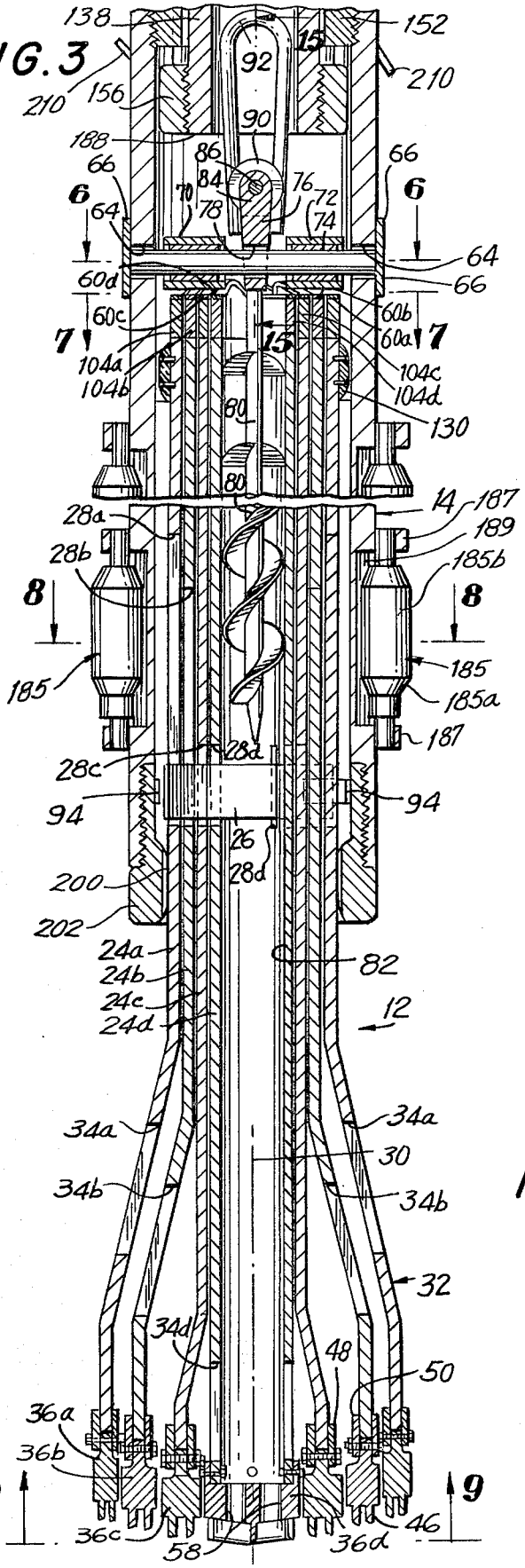
FIG. 3 is a section view taken along line 3—3 of FIG. 1 illustrating the drill assembly and associated casing of the drill apparatus of the present apparatus.

Referring to FIG 3, the drill assembly 12 comprises a plurality of elongate, coaxially extending pipe members 24*a*, 24*b*, 24*c* and 24*d*, each of which is located within the interior of the other so as to define an outer pipe member 24*a*, an inner pipe member 24*d* and two intermediate pipe members 24*b*, 24*c*. Although the drill assembly illustrated in the preferred embodiment comprises four such pipe members 24, it is understood that the drill assembly can comprise more or less pipe members depending upon the particular application.

The pipe members 24 are mutually interconnected by means of a bar 26 which extends diametrically through pairs of radially aligned, vertically extending slots 28*a*–28*d* formed in pipe members 24*a*–24*d*, respectively. Thus, each pipe 24 has a pair of diametrically opposed slots 28 formed therethrough through which bar 26 extends, the ends of bar 26 extending a small distance beyond the outer surface of outer pipe members 24*a*. The slots 28 extend in a vertical direction through varying degrees. More particularly, the slots 28*a* formed in outer pipe member 24*a* extend upwardly to the greatest extent, the slots 28*b* formed in pipe 24*b* extending upwardly to a somewhat lesser extent and the slots 28*c* and 28*d* in the present embodiment having the same upward extent which is considerably less than that of slots 28*a* and 28*b*. As seen in FIG. 3, however, all of the slots 28 terminate at their lower end in the same horizontal plane. It is seen from the above that the bar 26 interconnects the pipe members 24 in a manner such that the pipe members are mutually fixed to each other for simultaneous rotation about the longitudinal axis 30 of the drill assembly but that each pipe member is free to move in the axial direction independently relative to the other pipe members as determined by the vertical extent of the respective slots 28.

Still referring to FIG. 3, the drill head 32 is formed by the lower end region of drill assembly 12. In the illustrated preferred embodiment, drill head 32 is defined by the lower end region of each of the pipe members 24, each of which (with the exception of the inner pipe member 24*d*) has an outwardly flared, substantially conical configuration. Openings 34*a*, 34*b* and 34*d* are formed in the flared wall portions of the respective pipe members 24*a*, 24*b* and 24*d* in a manner such that the openings 34*a* in outer pipe member 24*a* are somewhat vertically offset above openings 34*b* in pipe member 24*b*, the latter openings being vertically offset relative to openings 34*d*. No openings are provided in pipe 24*c* in order to facilitate the circulation of mud according to the invention as described below. As further discussed below in connection with the description of the withdrawal operation of the drill apparatus 10., the provison of openings 34 in combination with the particular manner in which the pipe members 24 are interconnected greatly facilitates the withdrawal operation.

Figure 16:
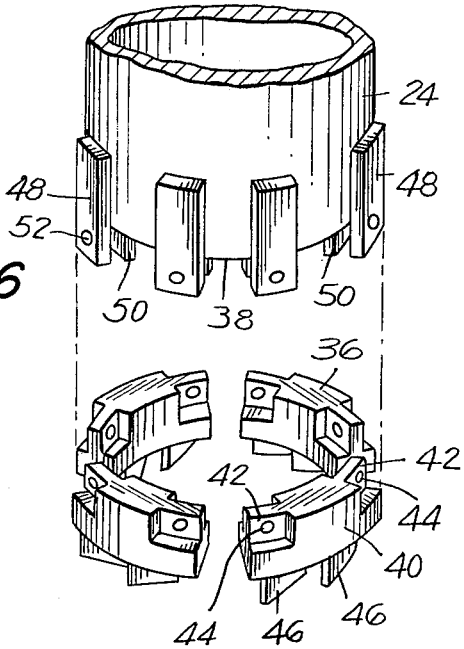
FIG. 16 is an exploded perspective view illustrating the connection of the cutting blade inserts onto the lower end region of the pipe member.

Referring to FIGS. 9 and 16–18 in conjunction with FIG. 3, cutting blade inserts 36*a*–36*d* are removably affixed to the lower edge surfaces 38*a*–38*d* of the respective pipe members 24*a*–24*d*. As best seen in FIG. 16, each cutting blade insert 36 (with the exception of insert 36*d*) comprises an arcuate body portion 40 preferably extending about 75°–80° having a pair of vertically extending ears 42 of a thickness substantially equal to the thickness of the pipe member 24 and through each of which a bore 44 is formed. Integrally formed on the lower surface of each insert body portion 40 are a plurality of cutting blades 46, the cutting blade inserts intended for connection to the outer pipe members e.g., pipe member 24*a*, having a greater number of cutting blades 46 than the inserts intended for connection to the inner pipe members, e.g., pipe member 24*c*.

Figure 9:
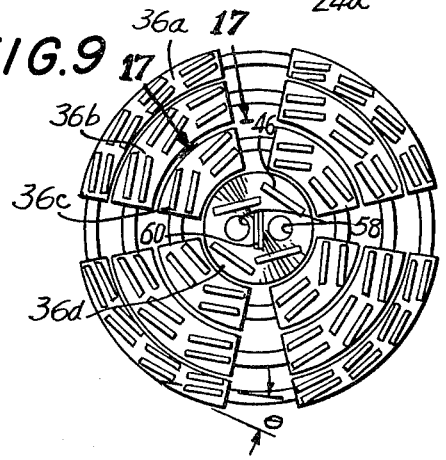
FIG. 9 is a bottom plan view in the direction of line 9—9 of FIG. 3 illustrating the cutting blades provided on the lower end region of the drill assembly.
Figure 17:
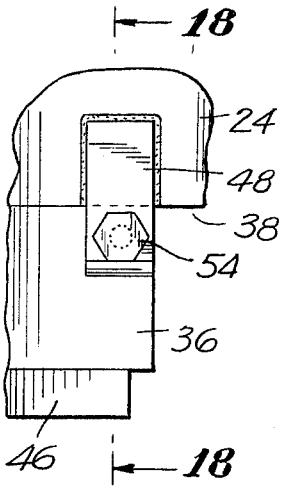
FIG. 17 is a view taken along line 17—17 of FIG. 9 illustrating the connection of a cutting blade insert to the lower end of a pipe member.
Figure 18:
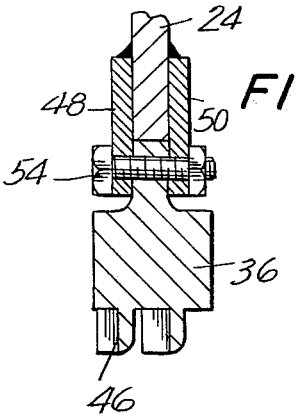
FIG. 18 is a section view taken along line 18—18 of FIG. 17.

Referring to FIGS. 16–18, in the preferred embodiment, four cutting blade inserts 36 are removably affixed to the lower edge surface 38 of each pipe member 24 so that a plurality of cutting blades 46 are circularly arranged at the lower end of each pipe member as best seen in FIG. 9. The cutting blade inserts are affixed to the pipe members in a removable fashion. Thus, preferably, eight pairs of opposed brackets 48, 50 are affixed, such as by welding, to the outer and inner surfaces, respectively, of each pipe member 24 so at least to partially extend below the lower edge surface 38 thereof. Aligned bores 52 are formed in each pair of opposed brackets 48, 50 (FIG. 16) and the brackets are spaced so that bores 52 align with the bores 44 provided in ears 42 of cutting blade inserts 36. The cutting blade isnerts 36 are affixed to the lower edge surface 36 of pipe members 24 by means of threaded fasteners 54.

Several important advantages are obtained by virtue of the above described structure. More particularly, the drill apparatus has a significantly greater bearing pressure capacity due to the columnar configuration of the drill assembly and associated cutting blade inserts so that greater axial loads can be applied during the drilling operation with a significant reduction in the frequency of breakage of the cutting blades. In the case where a cutting blade must be replaced due to either breakage or the blade becoming dull during use, it is a simple matter to remove the particular cutting blade insert and replace the same with a new one. Such structure is significantly more advantageous than the typical conic cutting blade which is provided on the lower end of conventional drill apparatus merely by a connecting bearing.

As seen in the figures, the cutting blades 46 are slightly angularly offset with respect to the direction of rotary motion of the drill assembly, i.e., each blade forms an angle $\theta$ with the direction of movement thereof. This feature is advantageous in that the cutting blades tend to self-sharpen during the drilling operation.

Figure 19:
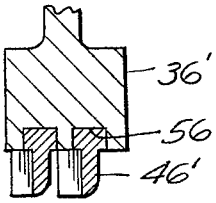
FIG. 19 is a section view of a cutting blade insert according to another embodiment of the present invention.

Referring to FIG. 19, an alternate form of the cutting blade insert, designated 36′, is illustrated which essentially has the same configuration as inserts 36. However, the cutting blades, designated 46′, are formed as separate members and are themselves inserted in slots 56 formed in the lower surface of insert 36′. This embodiment is particularly useful where an extremely hard material is necessary for the cutting blades and where it is not desired to form the entire cutting insert from this material. It is further advantageous in that upon the cutting blades becoming dull, it is necessary only to replace the cutting blades 46′ while retaining the body portion of cutting blade insert 36′.

The cutting blade insert 36*d* provided on the lower edge surface 38*d* of inner pipe member 24*d* differs from the cutting blade inserts described above in that it essentially comprises a disc-shaped body portion having a pair of longitudinally extending bores 58 (FIGS. 3 and 9) formed therethrough and in the preferred embodiment has four peripheral cutting blades 46 and a central cutting blade 60 extending downwardly therefrom. Cutting blade insert 36*d* has an upwardly extending annular flange which is affixed to the lower edge surfce of inner pipe member 24*d* by bolts or the like.

Returning to FIG.3, the upper region of drill assembly 12 is located within the interior of cylindrical casing 14 and as illustrated FIG. 3, drill assembly 12 is in its normal or "balanced" configuration. In this balanced configuration, the upper edge surfaces 60*a*–*60d* of the respective pipe members 24*a*–24*d* are located in substantially the same horizontal plane by means of certain structure affixed to casing 14 described in detail below. In the balanced configuration, the central cutting blades 46 extend slightly below the outer cutting blades with the intermediate cutting blades being slightly lower towards the center. In this manner, a conic cutting blade configuration is achieved.

Figure 6:
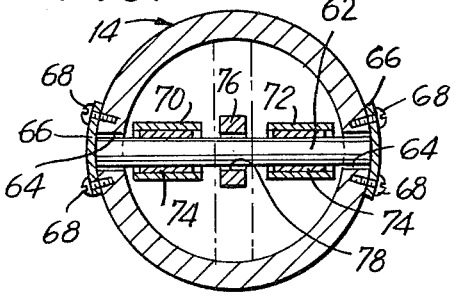
FIG. 6 is a section view taken along line 6—6 of FIG. 3 and illustrating the roller arrangement.
Figure 15:
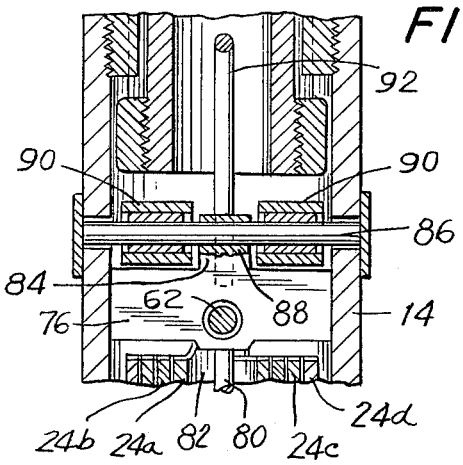
FIG. 15 is a section view taken along line 5—5 of FIG. 3.

Referring to FIGS. 6, 10 and 15, in conjunction with FIG. 3, a shaft 62 extends diametrically through the interior of casing 14 at its substantial mid-region and has its ends held within diametrically opposed openings 64 by means of brackets 66 fixed to the interior surface of the casing by means of conventional fasteners 68 (FIG. 6). A pair of cylindrical rollers 70, 72 are rotatably mounted on the end regions of shaft 62 by means of bushings 74. A beam 76 having a downwardly tapering cross section is fixed at its ends to casing 14 and extends transversely to shaft 62, the latter being fixed within an opening 78 formed in beam 76. The lower edge of beam 76 extends below shaft 62 to an extent somewhat less than the downward extent of rollers 70, 72. An hydraulic screw 80 has its upper end fixed, such as by welding, to the lower edge of beam 76 as seen in FIG. 3, screw 80 extending downwardly within the axially extending interior bore 821 of inner pipe 24*d*. Beam 76 has a central upwardly extending platform portion 84 to which the central portion of a shaft 86 is rotatably mounted by a journal 88, the end regions of shaft 86 being fixed within the wall of casing 14 (FIG. 15). A pair of safety rollers 90 are rotatably mounted on the end regions of shaft 86 and are free to rotate, i.e., are spaced from the lateral regions of beam 76. A hook or bail member 92 has its ends fixed to the side surfaces of beam 76 and extends upwardly through the interior of casing 14 as seen in FIGS. 3 and 10.

The casing 14 is located over the drill assembly 12 until the upper edge surfaces 60*a*–60*d* of the respective pipe members 24*a*–24*d* engage the surfaces of rollers 70, 72 as seen in FIG. 10. Thus, when the upper edge surfaces 60 of all of the pipe members 24 engage the rollers 70, 72, the drill assembly 12 is in its balanced configuration. As noted above, the lower edges of slots 28*a*–28*d* of respective pipe members 24*a*–24*d* are in this configuration substantially aligned as seen in FIG.3 at a location slightly spaced from the lower edge of bar 26.

Referring to FIGS. 3, 8, 21 and 22, four flexible assemblies 94 are fixed within respective recesses 95 (FIG. 21) formed in the inner surface of casing 14 in an equally spaced manner in a horizontal plane which passes substantially through the midsection of bar 26. In a preferred embodiment, each flexible assembly 94 includes an elastomeric member 96, formed of rubber or the like and a flexible steel band 98 whose ends are affixed to the interior surface of casing 14 by means of conventional fasteners or the like. These flexible assemblies 94, in addition to structure described below, serve to impart a periodic rotational torque to the drill assembly 12. More particularly, as the casing 14 rotates, the flexible assemblies 94 engage the ends of bar 26 which extend beyond the outer pipe member 24*d* tending to rotate the same. By their flexible nature, the assemblies 94 deform upon impact with the ends of bar 26 and bypass the same through the space 100 (FIG. 22) defined between the ends of bar 26 and the interior surface of casing 14. In this connection, a longituidnally extending slot 102 (FIG. 21) is provided in each band 98 so that each band can be movably adjusted whereby the inward extent of each flexible assembly 94 can be suitably adjusted utilizing elastomeric members 96 of appropriate thickness. In this manner the magnitude of the imparted torque can be varied as desired.

Referring now to FIGS. 7, 10–13 and 24, in conjunction with FIG. 3, the present embodiment of the invention includes the provision of cam surfaces on the upper edge surfaces of the respective pipe members forming the drill assembly 12. The cam surfaces are provided on each of the respective pipe members by means of a cam surface insert 104 best seen in FIG. 12. Thus, each of the pipe members 24*a*–24*d* are provided at their upper ends with respective cam surface inserts, 104*a*–104*d*, respectively. Each cam surface insert 104 has a ring-shaped configuration which has substantially the same cross sectional configuration as the respective pipe member to which it is attached but has a wall thickness which is slightly greater than the thickness of the pipe member wall. Thus, referring to FIG. 12, each cam surface insert 104 has a cylindrical body portion 106 which preferably has the same outer diameter as the corresponding pipe member 24 to which it is to be attached and a slightly smaller inner diameter. A pair of diametrically opposed slots 108 are formed in the upper surface of body portion 106 into each of which a cam member 110 is received. Thus, the cam surface insert 104 forms an upward extension of the corresponding pipe member 24 so that its upper surface, in fact, constitutes the upper edge surface 60 of each pipe member 24. Since the cam surface inserts are slightly thicker than the correspondig pipe members, there is substantially no spacing between these inserts upon assembly. In this connection, the discussion hereinabove relating to the location of the upper edge surfaces of the pipe members 24 in fact had reference to the upper edge surface of the cam surface insert 104 when this particular structure is utilized in connection with providing the cam surfaces on the upper edge surface of each pipe member.

Each cam member 110 has a cam surface portion 112 (FIG. 12) which inclines upwardly and forwardly in the direction of the movement of rollers 70, 72 and a substantially vertically extending cam surface portion 114 extending between the uppermost region of cam surface 112 and the upper edge surface 60. The cam members 110 are preferably removably fixed within slots 108 by means of conventional fasteners.

Each cam insert 104 is removably affixed to its corresponding pipe member and in the preferred embodiment, this removable connection is accomplished by means of four resilient pins 116 fixed at one end 118 of brackets 120 which are fixed, such as by welding, to the interior surface of each corresponding pipe member 24. Each pin 116 has a substantially horizontally extending portion 112 which extends almost the entire width of the pipe member wall. Four bores 124 are formed through the body portion 106 of cam insert 104 in locations adapted to be aligned with the horizontally extending portions 122 of pins 116. Thus, each cam insert 104 is removably affixed to the upper end of the corresponding pipe member 24 by flexing the resilient pins 116 inwardly, appropriately locating cam insert 104 on the top of the pipe member 24 and allowing the pins 116 to return to their normal position whereupon the horizontally extending portions 122 extend through the aligned bores 124. It will be seen that in this manner, each cam insert 104 can be easily removed from its corresponding pipe member 24. To complete the assembly, an annular wear surface member 126 is provided over the upper edge surface 60. The wear surface 126 (FIG. 11) is appropriately shaped to conform to the profile of the upper edge surface 60 of each cam insert 104 and includes a pair of cam member receiving portions 128 substantially corresponding to the profile of the cam members 110.

Figure 7:
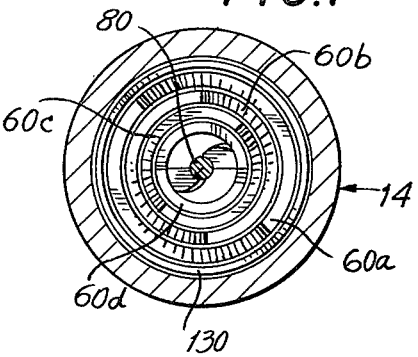
FIG. 7 is a section view taken along line 7—7 of FIG. 3 and illustrating the cam surfaces provided on the upper edges of the pipe members comprising the drill assembly.
Figure 8:
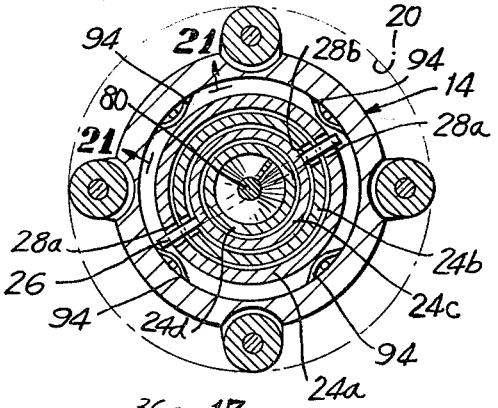
FIG. 8 is a section view taken along 8—8 of FIG. 3.
Figure 24:
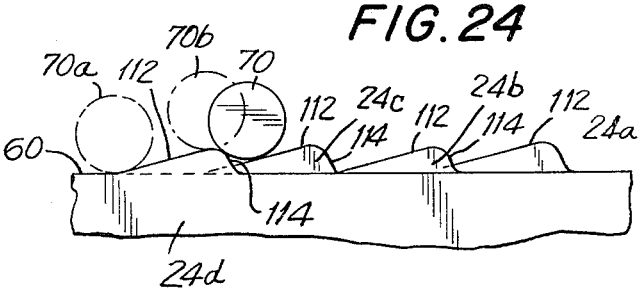
FIG. 24 is a schematic view of the top end region of the drill assembly illustrating the manner in which the rollers engage the cam surfaces provided on the upper edges of the respective pipe members during normal operation as seen from inside the innermost pipe member.

Referring to FIGS. 7, 10 and 24, it is seen that the cam inserts 104*a*–104*b* are so located on the respective pipe members 24*a*–24*d* that the cam surfaces provided on the respective pipe members are circumferentially offset relative to each other. Thus, referring to FIG. 24 which schematically illustrates a preferred arrangement of the cam surfaces viewed in a direction from the central or innermost pipe members 24*d* outwardly, it is seen that the substantially vertical cam surface portion 114 on the upper edge surface of the inner pipe member 24*d* slightly overlaps the initial portion of the inclined cam surface portion 112 of pipe member 24*c* while the substantially vertical cam surface portion 114 on pipe member 24*c* slightly overlaps the initial portion of the inclined cam surface portion 112 of pipe member 24*b* and, similarly, the substantially vertically extending cam surface portion 114 of pipe member 24*b* overlaps the initial portion of the inclined cam surface portion 112 of outer pipe member 24*a*. Of course, a substantially identical profile is presented by the other ones of the cam members 110 provided at the diametrically opposite locations of the respective cam inserts 104.

The operation of the drill assembly 12 can now be described. Thus, as mentioned above, the upper region of drill assembly 12 is located within the interior of casing 14 until the upper edge surfaces 60 of the respective pipe members 24 engage the rollers 70, 72. In this connection, an annular guide member 130 (FIG. 3) is preferably fastened to the exterior surface of the upper region of outer pipe 24*a*, the guide member 130 being formed of a metallic material having a convex outer surface which facilitates a self-lubrication of the frictional contact thereof with the internal surface of casing 14 as the mud circulates therethrough. The member 130 functions to axially align the drill assembly within the casing 14 and to maintain the outer surface of the outer pipe member 24*a* spaced from the inner surface of casing 14. During the drilling operation, the casing 14 is rotated by means described below whereby a periodic rotational torque is applied to the drill assembly 12 by means of the flexible assemblies 94 engaging the ends of bar 26 as described above. As the casing 14 rotates, the rollers 70, 72 bear against the upper edge surface 60 of the respective pipe members 24 and rotate over these surfaces being carried by the shaft 62 which rotates together with the casing 14. Referring to FIGS. 10 and 24, as the rollers 70, 72 travel over the upper edge surfaces 60 of pipe member 24, they periodically roll over the cam surfaces of cam member 110. For example, referring to FIG. 24, the roller 70 will leave the planar portion of upper edge surface 60 and begin to roll over the inclined cam surface portion 112 of the inner pipe member 24*d* as indicated by 70*a* and eventually reaches the uppermost elevation on the inclined cam surface portion, designated 70*b*. During the period of this engagement a rotary torque is applied by the roller 70 (and by the corresponding roller 72 acting on the diametrically opposed cam member of the inner pipe member (24*d*). This rotational torque is transmitted through bar 26 to all of the pipe members comprising drill assembly 12. Upon rotating beyond the end of upwardly inclined cam surface portion 112, the roller falls with some force onto the upwardly inclined cam surface 112 of the next outer pipe member 24*c*. This action imparts a downwardly directed, longitudinal force to the pipe member 24*c*. As casing 14 continues to rotate, the rollers 70, 72 continually ride upwardly over the inclined cam surface portions 112 thereby imparting the torque to the drill assembly 12 whereupon they fall onto the next cam surface thereby applying a downwardly directed force to the respective pipe member. In this manner, an impulse torque is applied to the drill assembly 12 and, additionally, an impulse force in the downward direction is sequentially applied to the respective pipe members. The sequential application of impulse forces in the respective pipe members results in a vibratory action of each of the pipe members, each vibratory motion for each member being independent from that of the other pipe members by virtue of the fact that the pipe members can axially move with respect to each other. The vibratory action results in an improved breaking action for the drill apparatus, the vibratory motion typically being on the order of about 200 vibrations per minute, depending upon the rate of rotation of casing 14, the number of cam members provided on each cam insert, etc.

The magnitude of the periodic rotational torque and downward force applied by the rollers 70, 72 can be adjusted by altering the configuration of the cam surface of cam members 110. This is easily accomplished either by replacing the cam inserts 105 with new cam inserts having cam members with different profiles or, alternatively, replacing the cam members 110 themselves in the same cam insert 104. In this connection, referring to FIG. 14, an alternate embodiment wherein the cam surface is provided on the upper edge surface of each pipe member as illustrated. Thus, each pipe member itself may be provided with a groove 132 into which a cam member 134 is fixed by a bolt or the like. A separate wear surface member 136 may be provided as shown. Referring to FIG. 14A, alternatively, a cam insert 104 which is substantially identical to the insert shown in FIG. 12 may be affixed to its respective pipe member 24 by means of a bolt 137 which passes through cam member 134 simultaneously fixing the latter in its groove 132.

Figure 23:
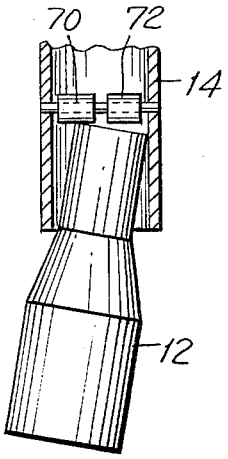
FIG. 23 is a partial section view of the drill assembly and lower region of the associated casing and illustrating the self-balancing capability thereof.
Figure 25:
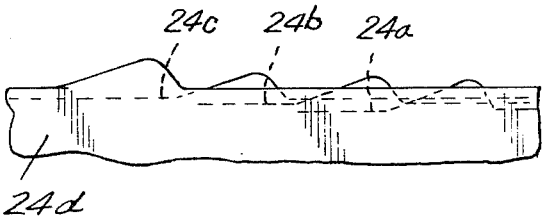
FIG. 25 is a view similar to FIG. 24 illustrating the relative locations of the cam surfaces during a time when the drill apparatus is in a self-balancing operation.

An important advantage provided by the particular structure of the drill assembly 12 and roller structure described above is that the drill apparatus is provided with a self-balancing capability not found in conventional drill apparatus. More particularly, as mentioned above, it not uncommon for a portion of the drill head to encounter material during the drilling operation which is harder than the material encountered by other portions of the drill head. In conventional drill apparatus, this has presented a serious problem which significantly reduced the rate at which the drill apparatus could penetrate into the earth. This situation also frequently resulted in the direction of the well bore being deflected from its intended direction. Thus, according to the present invention, the drill apparatus adapted to compensate for such an occurrence. More particularly, referring to FIGS. 23 and 25, assuming that a harder material is encountered by the left portion of the drill head, the drill assembly 12 will tend to align itself as illustrated in FIG. 23 which, of course, is greatly exaggerated for purposes of clarity. As seen in FIG. 25, the respective pipe members 24*a*–24*d* are vertically displaced relative to each other, the innermost pipe member 24*d* being the lowest with the height of the pipe members increasing in the outer direction. In this manner, as the casing 14 rotates, a greater rotational torque and downward force will be exerted on the left side region of drill assembly 12 by rollers 70, 72 than on the right hand region thereof. These increased forces exerted on the left hand region of drill assembly 12 results in a greater cutting action being exerted on the harder material located at this region. In this manner, the present invention provides a drill apparatus which is self-balancing in that when a harder material is encountered by the drill head during the drilling operation, additional forces are exerted to compensate therefor.

It is also noted in this connection that a similar effect will obtain when certain ones of the cutting blades 46 become duller than other ones of the cutting blades so that this situation will alos be compensated during operation.

Referring now to FIGS. 1–5, it is desirable to provide a damping mechanism, generally designated 16, in order to assure that the vibrations of the drill assembly 12 are damped and will not be transmitted to the upper portions of the drill apparatus which may result in an overstressing of these upper components. In this connection, a cylindrical pipe member 138 has its lower end region 140 received within the upper end region of casing 14 and its upper end region 142 received within the lower end region of a hollow cylindrical shaft 144. In each case, the respective end region 140, 142 of pipe member 138 is connected within the respective upper and lower region of casing 14 and cylindrical shaft 144 in a telescoping manner, i.e., in a manner such that the members are axiably slideable relative to each other but rotatably fixed to each other so that a rotational torque can be transmitted from cylindrical shaft 144 to casing 14 through pipe member 138. Thus, referring to FIG. 5, the lower end of cylindrical shaft 144 is provided with internal screw threads and a collar 146 provided with similar threads to detach as shown. Dovetail slots 148 are axially formed along the interior surface of collar 146 which slideably receive dovetail keys 150 formed on the outer surface of the upper end region 142 of pipe member 138. Similarly, a collar 152 is connected to the upper end of casing 14 which is provided with dovetail slots which receive dovetail keys formed on the lower end region 140 of pipe member 138. It is seen from this dovetail key or spline connection that cylindrical pipe member 138 can telescope within the interiors of casing 14 and shaft 144. Upper and lower caps 154 (FIG. 2) and 156 (FIG. 3) are provided exteriorly at the upper and lower ends of cylindrical pipe member 138 to prevent the latter from disassociating itself from casing 14 and 144.

An alternate arrangement is possible whereby the cylindrical pipe 138 may be suitably connected to the cylindrical shaft 144 and, of course, to casing 14. Thus, the collar 146 can have a plurality of axially extending rectangular slots 158 formed in its interior surface while the upper end region 142 of pipe member 138 has a corresponding plurality of slots 160 formed therein. When the slots 148, 160 are radially aligned, elongate keys 152 are disposed in the space defined therebetween thereby allowing a telescoping axial relative movement while providing the capability of torque transmission. Of course, the same arrangement may be used to accomplish the connection of the lower end region 140 of pipe member 138 to the casing 14.

A pair of annular flanges 164, 166 extend outwardly from cylindrical pipe member 138 in spaced, opposed relationship to the end surfaces of collars 146, 152, respectively. The flanges 164, 166 have annular channels 168, 170, respectively formed therein and, similarly, collars 146, 152 have channels 168, 170 of flanges 164, 166, respectively. A pair of coil springs 176, 178, each has its ends respectively located in the opposed channels of each collar and flange. Thus, spring 176 has its ends received within channels 168 and 172, while spring 178 has its ends received within channels 170 and 174. In this manner, when no load is applied to the assembly, the cylindrical pipe member 138 is spaced from the casing 14 and hollow cylindrical shaft 144, a predetermined amount.

It will be seen that during the operation of the drill apparatus, the vibrations transmitted from the drill head will be damped by springs 176, 178 which absorb the vibrational forces by allowing a certain amount of reciprocating, telescoping, movement of the cylindrical pipe member 138 within casing 14 and cylindrical shaft 144.

As seen in FIG. 1, an additional coil spring 180 is provided for additional vibration damping. Spring 180 extends between a flange 182 provided on the lower end of shaft 18 and the upper end of the hollow cylindrical shaft 144.

Figure 4:
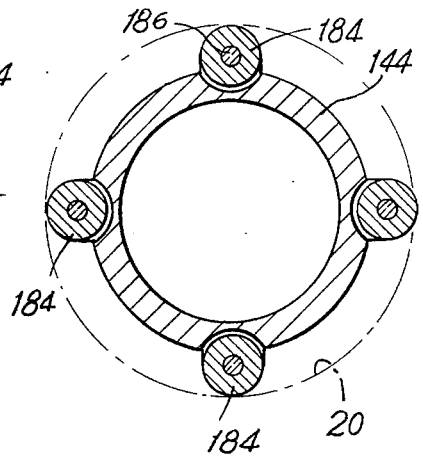
FIG. 4 is a section view taken along line 4—4 of FIG. 2.
Figure 5:
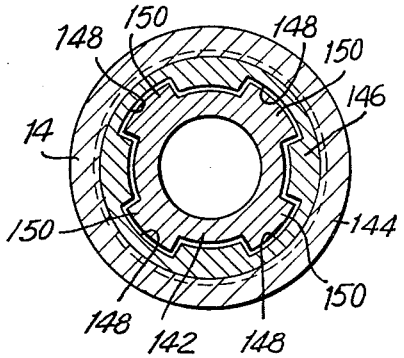
FIG. 5 is a section view taken along line 5—5 of FIG. 2.
Figure 5A:
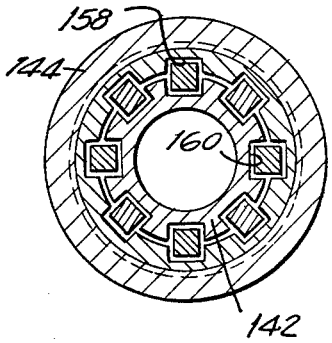
FIG. 5*a* is a view similar to FIG. 5 illustrating an alternate embodiment for the interconnection of the telescoping cylindrical pipe member and associated hollow cylindrical shaft.

Additional damping of the vibrations is accomplished by the provision of rollers 184 on the outer surface of shaft 144. In the preferred embodiment, four rollers 184 are mounted on vertically extending shafts 186 whose ends are mounted in bearings housed in flanges, extending from the side of shaft 144. As seen in FIG. 4, the outer regions of rollers 184 engage the surface of the well bore 20 during the drilling operation and tend to restrain any movement of shaft 144 with respect to the bore 20. This in turn results in causing the vibrational energy to be absorbed substantially entirely by springs 176, 178.

Figure 20:
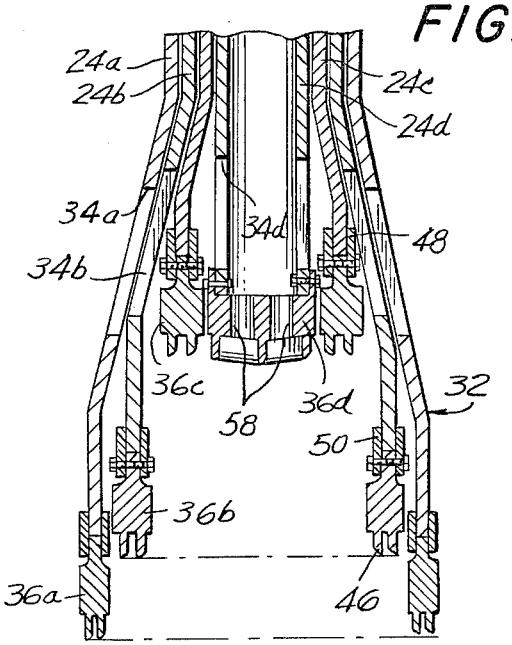
FIG. 20 is a section view of the lower end region of the drill assembly of the present invention as the same is being withdrawn from the well.
Figure 21:
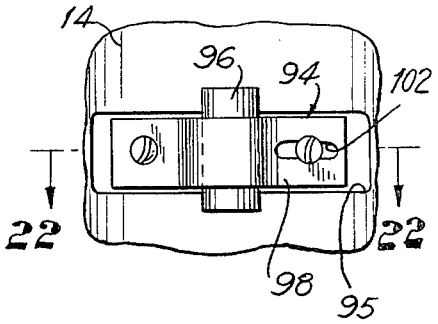
FIG. 21 is a partial elevation view of the inner surface of the casing in which is provided a flexible member for imparting a rotational torque to the drill assembly.
Figure 22:
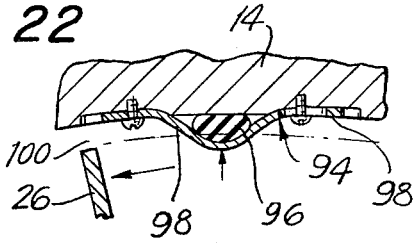
FIG. 22 is a section view taken along line 22—22 of FIG. 21.

The present invention also has the advantages of greatly facilitating the withdrawal of the drill apparatus from the well 20 subsequent to the termination of the drilling operation. Thus, referring to FIG. 20, when it is desired to withdraw the drill apparatus from the well bore 20, the shaft 18 is pulled upwardly whereupon the casing 14 begins to ascend until an inwardly directed protuberance 200 formed on the lower collar 202 engages the ends of bar 26. As casing 14 continues to ascend, the upper edge of bar 26 first engages the upper edges of slots 28*c* and 28*d* of pipe members 24*c*, 24*d* whereupon these pipe members begin to rise with the pipe members 24*c* and 24*d* remaining stationary. As withdrawal continues, the bar 26 engages the upper edge of sots 28*b* whereupon pipe member 24*b* begins to rise, and, finally, bar 26 engages the upper edge of slot 28*a* whereupon the pipe member 24*a* begins to rise. At this time, the drill assembly has the configuration illustrated in FIG. 20. As noted above, the opening 34*a* and 34*b* formed in pipe members 24*a* and 24*b*, respectively, thereby become substantially radially aligned to allow the mud and other debris located outside of the outer pipe member 24a to fall through the openings inwardly so that no obstructions are presented to the withdrawal of the drill apparatus and the formation of a vacuum is prevented. This feature is extremely advantageous since withdrawal of conventional drill apparatus has in the past been quite difficult and slow.

The insertion of the drill assembly is further faciliated by the provision of rollers mounted on the outer surface of casing 14 at the lower region thereof (FIG. 3). In the preferred embodiment, four rollers 185 are mounted in equally spaced relationship to each other so as to be rotatable about an axis parallel to the axis 30. Each roller 185 has a downwardly tapering portin 185a merging into a main body portion 185b. The roller shaft is mounted within bearings housed within flanges 187. The rollers 185 are received within recesses 189 formed in the surface of casing 14 and are so formed that the reduced diameter portion of tapering portion 185a is substantially aligned with the outer surface of outer pipe member 24a. In this manner, the well bore will be widened by action of the tapering portions 185a contacting the bore surface as the drill assembly is lowered, the bore being widened to a diameter defined by the outer extend of main body portons 185b of rollers 185.

An advantageous safety feature is also provided by the structure described above. More particularly, there is a possibility that the shaft 62 will fail by shearing due to fatigue stresses occurring therein after a long period of operation. Referring to FIGS. 3, 10 and 14, upon such failure, the casing 14 will move downwardly with respect to drill assembly 12 until the lower edge surface 188 of the pipe member 138 and associated cap 156 abuts against the safety rollers 90. At this point, however, the drill components above casing 14 will be allowed to continue rotating with substantially no resisting torque being present by virtue of the rolling contact of the lower edge surface 188 of pipe member 138 and safety rollers 90. Of course, no further penetration of the drill will occur. This feature thereby limits any damage resulting from a breakage of shaft 86 to a minimum and further provides a ready indication of such a breakage through the marked decrease in torque required for rotation. Further, this safety feature eliminates any possibility of damage to the rotating apparatus 22 located above the ground which might otherwise result from such failure.

Further, in the case of breakage of the drive shaft 18 (FIG. 1), the present invention enables the recovery of the drill apparatus 12. More particularly, a conventional stringer is lowered through the axial bore of shaft 18 and through the aligned bores in shaft 144 and pipe 138, the lower end of the stringer having an appropriate hook-like member which engages bail 92. Upon engagement, the stringer is pulled upwardly, whereupon casing 14 will be drawn upwardly through its connection to bail 92 by virtue of shaft 62 and beam 76.

According to another feature of the invention, an improved mud circulating system is provided. Thus, during the drilling operation, "clean" mud is pumped downwardly through the central bore of shaft 18 and eventually exits through the openings 58 provided in the central cutting blade insert 36d as well as through the annular space defined between the cutting blade inserts 36b and 36c. In this manner, the mud and other debris located at the bottom of the well bore will be forced through the openings 34b and 34a of pipe members 24b and 24a as well as between the spaces defined between blades 36c and 36b and 36b and 36a to eventually move upwardly within and out from the well bore. In this connection, the hydraulic screw 80 rotates with the drill apparatus and aids in the forced circulation of the mud. Further, impeller-type blades 210 (FIG. 1) are provided on the outside surface of the drill assembly to further facilitate the removal of the mud. It is seen that pipe 34c is not provided with an opening so that the circulating mud will be forced downwardly through the space between central cutting blade insert 36d and insert 36c whereby debris will be cleaned therefrom.

In operation, the conventional hollow shaft 18 is rotated by conventional rotating apparatus 22, the lower end of shaft 18 being connected to casing 14 through the vibration or damping mechanism 16. An impulse torque and axially directed impulse force are periodically applied to the drill assembly by means of the bar 26 and cooperating flexible assemblies 94 and by the cooperating rollers 70, 72 and cam surfaces provided on the upper edge surfaces of the pipe members. The vibratory action set up in the various pipe members can be adjusted by virtue of the interchangeable cam members and, similarly, the extent of the rotary torque applied can be adjusted by virtue of the flexible assemblies 94 and, also, by appropriate selection of the cam members. By virtue of the particular construction of the drill assembly 12, the drill head is self-balancing so as to compensate for variations in hardness of the material being drilled as well as for dulling of the cutting blades which takes place during the drilling operation. A significantly improved breaking action is achieved by virtue of the vibratory action of the drill assembly and the latter is easily adjustable for various diameter bores through the addition or deletion of one or more of the coaxial pipe members. The vibratory action as well as the provision of the hydraulic screw and impeller blades serve to facilitate the forced removal of mud and other debris from the bottom of the well bore. The vibration damping mechanism insures that the upper components of the drill apparatus will not be overstressed due to the vibration of the drill assembly. A greater bearing pressure may be applied to the drill head by virtue of the construction of the present invention wherein the blades are supported on columnar structure rather than merely being attached to the head by a bearing as typical. The removal of the drill apparatus from the bore is significantly facilitated by the particular provisions discussed above and the safety features provided insures a minimum of damage in the event of structural failure. The drill apparatus can be constructed from standard parts and is relatively simple in construction. Worn parts can be easily replaced by unskilled labor and it is not necessary to replace the entire drill head when one component thereof becomes worn. All of the above factors contribute to a significant increase in the speed of penetration of the drill apparatus of the present invention as well as a significant reduction in down time due to breakage or blade replacement.

Obviously, numerous modifications and variations of the present invention are possible in the light of the above teachings. It is therefore to be understood that within the scope of the appended claims, the invention may be practiced otherwise than as specifically disclosed herein.

What is claimed is:

1. Rotary drill apparatus comprising:

an elongate, substantially tubular casing adapted to be connected to a rotating shaft or the like;

a drill assembly comprising a plurality of elongate pipe members coaxially extending with respect to a common axis, each being located one within the other so as to define an outer pipe member and at least one inner pipe member, said drill assembly having an upper region which is received within the lower interior region of said casing and a lower region defining a drill head, means for interconnecting said pipe members such that said pipe members are mutually fixed to each other for simultaneous rotation about said axis and such that each pipe member is free to move in the axial direction independently relative to the other pipe members; and means for applying a torque to said drill assembly tending to rotate said drill assembly about said axis and for periodically applying to at least one of said pipe members an impulse force in the direction of said axis so as to vibrate the same.

2. Apparatus as recited in claim 1 wherein said torque applying means comprises means for periodically applying an impulse torque to said drill assembly tending to periodically rotate the same.

3. Apparatus as recited in claim 2 wherein said impulse means acts to periodically apply an axial impulse force to each of said pipe members sequentially.

4. Apparatus as recited in claim 2 wherein said pipe members each have an upper edge surface, said upper edge surfaces being located within said casing in a substantially coplanar relationship, and said impulse means comprises at least one inclined cam surface formed in the upper surface of at least one pipe member and at least one roller rotatably connected to said casing adapted to engage the upper edge surfaces of said pipe members in a manner such that as the casing rotates, said roller rolls over the upper edge surfaces of said pipe members and over said at least one cam surface, whereby a rotational torque is imparted to said drill assembly as the roller rolls over said cam surface and whereby an axial force is impated to at least one pipe member upon the roller disengaging said at least one cam surface.

5. Apparatus as recited in claim 4 wherein said cam surface is defined by a cam member which is removably fixed to the upper edge surface of the corresponding pipe member.

6. Apparatus as recited in claim 5 wherein said cam member is provided on a cylindrical cam insert member and means for removably affixing each of said cam inserts to its respective pipe member so that the upper edge surface of said cam insert member comprises the upper edge surface of said respective pipe member.

7. Apparatus as recited in claim 4 wherein said at least one cam member is removably affixed within a slot formed in the upper edge surface of the corresponding pipe member.

8. Apparatus as recited in claim 5 wherein at least one cam member is provided on the upper edge surface of each of said pipe members.

9. Apparatus as recited in claim 8 wherein the cam members provided on the respective pipe members are circumferentially off-set from each other.

10. Apparatus as recited in claim 8 wherein two cam members are provided on the upper edge surface of each of said pipe members.

11. Apparatus as recited in claim 10 wherein said two cam members on each of said pipe members are provided on substantially diametrically opposed regions of the upper edge surface thereof.

12. Apparatus as recited in claim 4 wherein said at least one roller comprises a pair of rollers rotatably mounted on the end region of a shaft which extends diametrically through the casing interior and has its ends affixed to the casing.

13. Apparatus as recited in claim 12 further including a beam member extending substantially perpendicularly relative to said shaft, said shaft freely passing through an opening formed in said beam member, a second shaft being rotatably mounted to said beam member over said shaft having its ends affixed to the casing.

14. Apparatus as recited in claim 2 wherein said means for interconnecting said pipe members includes a bar member and wherein each pipe member has a pair of diametrically opposed, vertically extending slots formed therein, the slots formed in at least one of the pipe members having a vertically higher extent then the slots formed in one of the pipe members located therewithin, said slots being radially alignable, said bar member extending through said slots.

15. Apparatus as recited in claim 14 wherein said impulse means is further defined by the end portions of said bar which extend beyond the outer surface of the outer pipe member and at least one deformable assembly affixed to the inner surface of the casing adapted to impact against said bar ends during rotation of said casing whereby said deformable assembly will deform and pass said bar end.

16. Apparatus as recited in claim 2 wherein openings are formed in the lower region of each of said pipe members through which mud and the like can pass during withdrawal of said drill apparatus from the well bore.

17. Apparatus as recited in claim 16 wherein the openings in the respective pipe members are displaced from each other during the drilling operation and further including means for substantially radially aligning said openings during insertion and withdrawal of said drill apparatus from the well bore.

18. Apparatus as recited in claim 17 wherein said aligning means comprises a bar member and a pair of diametrically opposed, vertically extending slots being formed in each of said pipe members, the slots formed in at least one of the pipe members having a higher vertical extent then the slots formed in one of the pipe members located therewithin, said slots having lower edges which are substantially coplanar, said slots being radially alignable and said bar member extending through said slots.

19. Apparatus as recited in claim 17 wherein said lower region of at least some of said pipe members define a substantially conic configuration and wherein said openings are formed in the conic portion of said pipe members.

20. Apparatus as recited in claim 2 wherein cutting blades are affixed to the lower edge surface of each of said pipe members.

21. Apparatus as recited in claim 20 wherein said cutting blades are removably affixed to the lower edge surface of each of said pipe members.

22. Apparatus as recited in claim 21 wherein said cutting blades are provided on arcuate shaped cutting blade inserts and means are provided for removably affixing said cutting blade inserts to the lower edge region of said pipe member.

23. Apparatus as recited in claim 22 wherein each of said inserts extend about 90° and wherein four inserts are adapted to be affixed to each of said pipe members except for the inner pipe member.

24. Apparatus as recited in claim 20 wherein said cutting blades define a small angle with respect to the direction of rotation of said drill assembly.

25. Apparatus as recited in claim 2 further including means for damping the vibrations of said drill assembly.

26. Apparatus as recited in claim 25 wherein said vibration damping means comprise a cylindrical pipe member received in the upper region of the interior of said casing said cylindrical pipe member being connected to said casing in a manner to permit axial telescoping relative movement thereof and so that torque can be transmitted from said pipe member to said casing, and spring means cooperating between said casing and cylindrical pipe member for absorbing said vibrations.

27. Apparatus as recited in claim 26 wherein said vibration damping means further includes a hollow cylindrical shaft which receives in its lower interior region the upper region of said cylindrical pipe member, said cylindrical pipe member being connected to said casing in a manner to permit axial telescoping relative movement thereof and so that torque can be transmitted from said cylindrical shaft to said pipe member, and spring means cooperating between said cylindrical shaft and pipe member for absorbing said vibrations.

28. Apparatus as recited in claim 27 wherein said vibration damping means further includes rollers mounted on the outer surface of said cylindrical shaft for rotation about a substantially vertical axis and adapted to engage the well bore to restrain said shaft from vertical movement.

29. Apparatus as recited in claim 2 further including hydraulic means for forcing the circulation of mud and other material from the bottom of the well bore to the exterior thereof in the space defined between the external surface of said apparatus and well bore.

30. Apparatus as recited in claim 29 wherein said hydraulic means includes a screw member located within the bore of the innermost one of said pipe members and operatively connected to said apparatus such that said screw rotates with said drill assembly.

31. Apparatus as recited in claim 29 wherein said hydraulic means further includes impeller-type blades fixed to the outer surface of said casing.

32. Apparatus as recited in claim 2 further including roller means mounted on said casing adapted to rotate about respective axes which are parallel to the axis of said drill assembly, each roller having a tapering portion whose minimum outwardly extending portion is substantially aligned with the outer configuration of said drill head.

* * * * *